United States Patent [19]

Winter et al.

[11] 4,229,210

[45] Oct. 21, 1980

[54] METHOD FOR THE PREPARATION OF THIXOTROPIC SLURRIES

[75] Inventors: Joseph Winter, New Haven; Derek E. Tyler, Cheshire; Michael J. Pryor, Woodbridge, all of Conn.

[73] Assignee: Olin Corporation, New Haven, Conn.

[21] Appl. No.: 859,132

[22] Filed: Dec. 12, 1977

[51] Int. Cl.[3] ..... C22D 7/06

[52] U.S. Cl. ..... 75/10 R; 75/72; 75/93 R

[58] Field of Search ..... 75/10 R, 129, 135, 63, 75/93 R, 65 R, 72; 164/51, 49, 251, 49; 13/26, 27; 366/273, 274

[56] References Cited

U.S. PATENT DOCUMENTS

| | | | |
|---|---|---|---|
| 2,419,373 | 4/1947 | Schrumm | 164/250 |
| 2,686,864 | 8/1954 | Wroughton et al. | 75/10 R |
| 2,861,302 | 11/1958 | Mann et al. | 164/147 |
| 3,020,323 | 2/1962 | Redfern | 13/27 X |
| 3,268,963 | 8/1966 | Mann | 164/51 |
| 3,463,365 | 8/1969 | Dumont-Fillon | 222/1 |
| 3,567,429 | 3/1971 | Dunkel et al. | 75/10 |
| 3,842,895 | 10/1974 | Mehrabian et al. | 164/49 |
| 3,857,696 | 12/1974 | Aldersley et al. | 75/65 R |
| 3,902,544 | 9/1975 | Flemings et al. | 75/10 R UX |
| 3,936,298 | 2/1976 | Mehrabian et al. | 75/134R |
| 3,948,650 | 4/1976 | Flemings et al. | 75/65 R |
| 3,951,651 | 4/1976 | Mehrabian et al. | 75/10 R |
| 3,954,455 | 5/1976 | Flemings et al. | 75/134 R |
| 3,995,678 | 12/1976 | Zavaras et al. | 164/49 |
| 4,030,534 | 6/1977 | Ito et al. | 164/147 |
| 4,040,467 | 8/1977 | Alberny et al. | 164/49 |
| 4,042,007 | 8/1977 | Zavaras et al. | 164/49 |
| 4,042,008 | 8/1977 | Alberny et al. | 164/47 |
| 4,099,960 | 7/1978 | Olschewski et al. | 75/10 R |

OTHER PUBLICATIONS

Fascetta et al., *AFS Cast Metals Research Journal*, Dec. 73, pp. 167–171.

Szekely et al., *Journal of Metals*, Sep. 76, pp. 6–11.

Flemings et al., *AFS International Cast Metals Journal*, Sep. 76, pp. 11–22.

Oberg et al., *Metallurgical Transactions*, Jan. 73, vol. 4, pp. 75–82.

*Primary Examiner*—M. J. Andrews

*Attorney, Agent, or Firm*—Victor A. DiPalma; Paul Weinstein

[57] ABSTRACT

The invention relates to an improved method for the preparation and delivery of semi-solid thixotropic metal slurries for use in metal forming processes such as the rheocast and thixocast processes. The method includes inducing turbulent motion within the metal during solidification by electromagnetic or electrodynamic techniques under controlled temperature conditions so as to produce a highly fluid semi-solid slurry with a degenerate dendritic structure comprising solid spheroids dispersed in liquid. In the method of the preferred embodiment of the present invention, flow of the thixotropic metal slurry from the vibrating chamber is controlled by electromagnetic techniques and may be continuous or semi-continuous.

6 Claims, 2 Drawing Figures

METHOD FOR THE PREPARATION OF THIXOTROPIC SLURRIES

BACKGROUND OF THE INVENTION

The present invention relates to an improved method of producing and delivering of a semi-solid thixotropic metal slurry for use in metal forming processes.

Present commercial metal forming processes employ either fully liquid metals or fully solid metals. Metal forming processes such as sand castings, die castings, and the like employ fully liquid metals while processes such as forgings, extrusions, etc., employ fully solid metals. Existing cast methods in which a metal is brought to a liquid state and then poured or forced into a mold have a number of shortcomings. In casting, when the liquid changes to solid, shrinkage of about 5% is encountered which initiates stress generations which results in cracking and casting porosity. In addition, the fully liquid melt is highly erosive to dies and molds and the high temperature of the liquid and its erosive characteristics makes difficult die casting of some high temperature alloys. The foregoing shortcomings can be alleviated by casting a controlled semi-solid mixture in the form of a thixotropic slurry. Traditionally, forming processes did not employ semi-solid metals because in the conventional solidification of the metals, a dendritic network structure forms when the alloy is as little as 20% solid. Such partially solidified metal cannot be deformed homogeneously without cracking or forming segregates.

The metal composition of a thixotropic slurry comprises primary solid discrete particles and a secondary phase. The secondary phase is solid when the metal composition is frozen and is liquid when the metal composition is partially solid and partially liquid. The primary solid particles comprise small degenerate dendrites or nodules which are generally spheroidal in shape. The primary solid particles are made up of a single phase or plurality of phases having an average composition different from the average composition of the surrounding matrix, which matrix can itself comprise primary and secondary phases upon further solidification. The primary solids obtained in the composition differ from normal dendritic structures in that they comprise discrete particles suspended in a liquid matrix. Normally, solidified alloys have branched dendrites separated from each other in the early stages of solidification and develop into an interconnected network as the temperature is reduced and the weight fraction solid increases. On the other hand, the structure obtained in thixotropic metal slurries consists of discrete primary particles separated from each other by a liquid matrix even up to solid fractions of 80 weight percent. The primary solids are degenerate dendrites in that they are characterized by smoother surfaces and less branched structures which approach a spherical configuration. The secondary solid which is formed during solidification from the liquid matrix, subsequent to forming the primary solid, contains one or more phases of the type which would be obtained during solidification of the liquid alloy in commercial casting processes. That is, the secondary solid can comprise dendrites, single or multi phase compounds, solid solutions, or mixtures of dendrites, compounds and/or solid solutions.

The known method used to prepare a thixotropic slurry as described above is disclosed in U.S. Pat. Nos. 3,948,650 and 3,902,544. The method comprises raising the temperature of an alloy to a value at which most or all of the alloy is in the liquid state and then agitating or stirring the liquid or semi-solid metal. The temperature of the melt is reduced to increase the solid fraction while agitating or stirring the melt to form discrete degenerate dendrites while avoiding the formation of a dendritic network. It is required that the agitating or stirring produce shear rates sufficient to break up the dendritic network structure traditionally formed during solidification and produce a slurry comprising solid spheroids dispersed in a liquid. As disclosed in the aforesaid patents, the preferred apparatus for agitating or stirring the molten metal slurry consists of a metal rod inserted into a cylindrical tube or chamber containing the solidifying alloy. In order to produce the necessary shear rates sufficient to break up the dendritic network structure when mechanically stirring as disclosed in the aforenoted patents, two parameters are critical. Firstly, in order to produce the necessary shear rates in the region of the stirring rod, the rod must be rotated at speeds in the range of 1,000 rpm. Secondly, since the effective shear rate in the slurry rapidly dissipates in areas radially removed from the stirring rod, there is a critical annular gap size between the rod and cylinder wall containing the metal which must be maintained in order to effect the necessary shear rate throughout the metal slurry. As a result of this procedure, extreme wear and erosion of the stirring rod occurs. Furthermore, as a result of the criticality of the gap maintained between the rod and the cylindrical tube, volumetric throughput is extremely limited. As a result of these disadvantages in the processes of the above-noted patents, the commercial exploitation of producing thixotropic slurries for rheocasting and thixocasting has been extremely limited.

The present invention contemplates an improved method for the preparation and delivery of semi-solid thixotropic metal slurries for use in casting processes which provide a high volume supply of semi-solid slurry.

Accordingly, it is the principal object of the present invention to provide an improved method of vibrating molten metal during solidification so as to produce a highly fluid semi-solid slurry with a degenerate dendritic structure comprising solid spheroids dispersed in liquid.

It is a further object of the present invention to provide a method for producing a thixotropic slurry which is capable of providing high flow rate delivery of the semi-solid slurry.

It is still a further object of this invention to provide an effective economical and commercial process for preparing and delivering semi-solid thixotropic slurries for use in metal forming processes.

SUMMARY OF THE INVENTION

In accordance with the present invention, the foregoing objects and advantages may be readily obtained.

The present invention contemplates a novel and unique method and apparatus for the preparation and delivery of semi-solid thixotropic metal slurries by utilizing electromagnetic forces to vibrate the molten metal while controlling the cooling rate thereof. The method comprises supplying a charge of metal which is at least 35% liquid and holding same by electromagnetic or mechanical means in an electromagnetic field sufficiently strong to effect the necessary shear rates to break up the dendritic network structure. The cooling rate of the metal is controlled during the electromagnetic vibration so as to produce a thixotropic slurry containing a volume fraction of solid between 20 and 80%. The thixotropic slurry is then delivered by mechanical or electromagnetic means to be cast into small ingots and quenched for later reheating or fed directly in a continuous or semi-continuous manner to a work station for further processing. It can be appreciated that the use of an electromagnetic force to effect vibration of the semi molten metal is far superior to the known aforenoted mechanical process. The method of the present invention overcomes the low volumetric throughput limitations noted in the casting processes of the aforenoted patents. In addition, the process of the present invention is an effective, economical and commercially feasible process for producing semi-solid thixotropic metal slurries for use in known metal forming processes.

DETAILED DESCRIPTION

Figure 1:
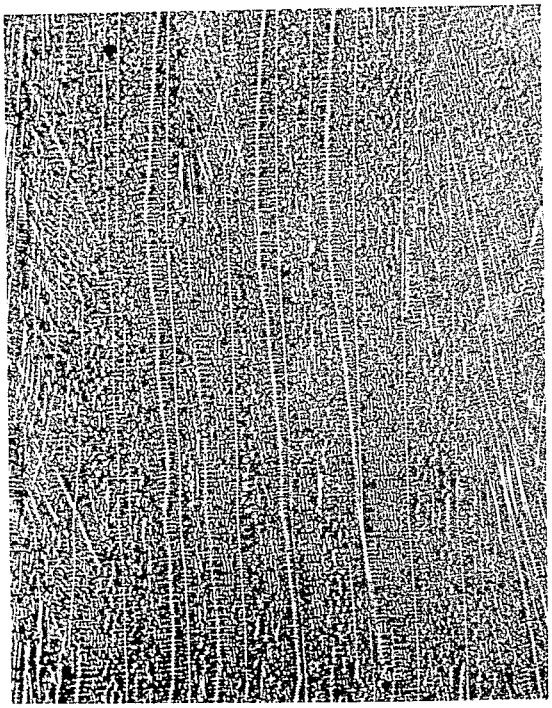
FIG. 1 is a micrograph of the structure of copper Alloy 510 which was cast by the typical chill cast method.

The invention relates to an improved method and apparatus for the preparation and delivery of semi-solid thixotropic metal slurries for use in known metal forming processes such as the rheocast and thixocast processes. The present invention focuses on an improved method for vibrating a molten metal under controlled cooling rates and delivering the same under controlled flow rates whereby a semi-solid thixotropic slurry of from 20 to 80% by weight solid is rendered. The semi-solid thixotropic slurry may then be fed in a continuous or semi-continuous manner by mechanical or electromagnetic means for known processing. In particular, the method is directed to vibrating a molten metal during solidification in an electromagnetic field under controlled cooling rates and holding the same in the electromagnetic field by mechanical or electromagnetic means so as to produce a highly fluid semi-solid thixotropic metal slurry which is characterized by a degenerate dendritic structure comprising solid spheroids dispersed in liquid.

In accordance with the present invention, a supply of metal is placed in an electromagnetic field for stirring, and held therein by the same or a second electromagnetic field. The metal may be 100% liquid or may be partially liquid and partially solid. In order to shear the dendritic network, the metal should be at least 35% liquid. The invention contemplates vibrating and stirring the molten metal during solidification by either using an induced AC electromagnetic field or the use of a pulsed DC current within an applied magnetic field. When using an induced AC electromagnetic current to effect the vibration of the molten metal, the molten metal is fed to and held in an AC induction coil. The molten metal may be held in the coil by conventional mechanical means. The preferred embodiment of the present invention contemplates holding the molten metal within the AC induction coil by electromagnetic means. The electromagnetic holding means may constitute a separate AC induction coil around the outlet passage from the stirring chamber or may be formed of a part of the AC induction coil used for vibrating the molten metal. In either case, by inducing the appropriate electromagnetic field around the outlet passage, the molten metal may be held within the induction coil and/or be allowed to continuously flow out of the induction coil at any desired rate. When using an AC induction coil to stir the solidifying metal, the primary variables effecting the degree of vibration of the molten metal and thereby the shear rate thereof are the frequency, which controls the depth of penetration, and the current, which controls the magnitude of the imposed force vectors. Typically, the frequency ranges from 60 to 10,000 cps and the current from 500 to 10,000 amps. Additionally, the coil dimensions such as length, number of turns, relative geometry, and cross section of molten metal are all variables which are capable of being manipulated to control the velocity vector field resulting from the induced electromagnetic forces. It should be noted that the AC current may be phased in a split induction coil so as to provide a continuous oscillating type of movement. Likewise, the frequency and current imposed will vary depending on the rate, if any, of molten metal which is allowed to continuously flow from the induction coil. As noted previously, the cooling rate of the molten metal is controlled so as to produce a semi-solid thixotropic metal slurry characterized by a volume fraction of solid between 20 and 80%, preferably from 40–70%. The shearing rate required to produce the degenerate dendritic structure of solid spheroids dispersed in liquid is imparted by the relative motion of adjacent regions within the partially solidified metal, the motion resulting from the induced AC field. The application of the induced AC field as set forth in the present invention will impart heat to the molten metal and thus effect the liquid solid equilibrium of the melt. Accordingly, it is necessary to provide a cooling means, such as an additional cooling coil or the cooled induction coil to cool the molten metal at the desired rate and thereby counteract the induced current heating effect in order to maintain the desired volume fraction of solid.

An alternate method of effecting the desired shearing of the molten metal to produce the desired semi-solid thixotropic metal slurry comprises the use of a pulsed DC current within an applied magnetic field. The co-imposition of the DC current within an applied magnetic field will impart an essentially uniform velocity field within the molten metal. In order to effectively vibrate the molten metal, the DC current must be pulsed while the magnetic field is held constant or vice versa. The magnitude of both the DC current and the magnetic field will control the strength of the imposed force vectors and thus the shear rate within the semi-solid metal. Typically, the DC current ranges from 100 to 5,000 amps and the magnetic field ranges from 0.1 to 5 webers/in.$^2$. By manipulating the magnitude of the DC current and magnetic field, the effective relative motion and turbulent flow in the molten metal may be controlled. Conductive ceramic materials inert to the molten metal such as non-stoichiometric reactive metal borides such as zirconium boride, titanium boride, tin oxide, graphite, etc., may be used to conduct the DC current into the melt. Again, as in the previous example, conventional mechanical means may be used to hold the molten metal within the pulsed DC current and magnetic field during vibration and partial solidification.

The preferred embodiment of the present invention contemplates the imposition of an electromagnetic field around the outlet passage to hold the molten metal within the DC current and magnetic field. The strength of this imposed electromagnetic field may be varied to control the flow rate of thixotropic slurry from the stirring chamber. Thus, the strength of the electromagnetic field may be such that the slurry is held in the stirring chamber or varied to produce the desired flow rate from the chamber. In addition, it should be noted that an additional electromagnetic field may be provided so as to forceably expel the thixotropic slurry from the stirring chamber if desired. It is further envisioned that a single electromagnetic field may be employed in a continuous chamber so as to effectively vibrate the molten metal while at the same time delivering said molten metal through the continuous chamber to a point of use.

In either of the above vibrating methods, AC induction coil or DC current within an applied magnetic field, the turbulent vibration of the cooling molten metal may be increased by the addition of some mechanical assistance in the vibrating chamber such as incorporating perturbations in the side walls, varying chamber geometry, or the like.

Vibrating molten metal by electromagnetic means as disclosed above offers an advantage over the preferred mechanical method disclosed in the aforenoted patents which is not contemplated in the prior art disclosures. As noted previously, in order to produce the necessary shear rates sufficient to break up the dendritic network structure thoughout the entire melt when mechanically stirring, the rod must be rotated at a high rpm and a critical gap size must be maintained between the rod and chamber wall. As a result, the volumetric throughput obtained by this mechanical method is extremely limited. Contrary to the above, when using the vibrating method of the present invention, the electromagnetic field used for stirring the melt is not dissipated in the same manner and to the same degree as when mechanically stirring. Thus, the method of the present invention does not require the use of chambers with critical gap sizes and as a result is not limited to the volume throughput as previously noted. In addition, the problems of erosion and wear experienced in the aforenoted method are eliminated.

As stated above, the present invention contemplates the delivery of the semi-solid thixotropic metal slurries which are produced in the manner described above in either a continuous or semi-continuous manner by controlling the force of the electromagnetic field produced in or around the outlet passage of the chamber in which the agitation of the metal slurries is carried out. The thixotropic slurries produced by the above-noted processes can be used directly as feed stock, such as in rheocasting, or may be cast into small ingots for later reheating, such as in thixocasting. It is preferred in the present invention that the delivery of the thixotropic slurry be achieved by utilizing AC induction or a DC current within a magnetic field of the same type as previously described. Typically, if utilizing AC induction to deliver the slurry, a current of from 500 to 10,000 amps at a frequency of from 60 to 10,000 cps is applied. If utilizing a DC current with a magnetic field, a current of from 100 to 5,000 amps within a magnetic field of from 0.1–5.0 webers/in.$^2$ is contemplated. Again, it should be appreciated that mechanical devices such as valves can also be used to aid in controlling the flow of the semi-solid thixotropic slurry.

It is a primary requisite of the present invention that the semi-solid thixotropic slurry produced is characterized by a volume fraction of solid between 20 and 80%, said solid being characterized by a degenerate dendritic structure of spheroidal shape. The volume fraction of solid produced in accordance with the present invention is preferably in excess of 40–70%. Again, as stated above, the degree of vibration and cooling rate of the molten metal will control the volume fraction of solid formed in the thixotropic slurry. As pointed out above, the degree of vibration, i.e., the shear rate, is controlled by the frequency, current, coil dimensions, magnetic field, etc., which are applied to the solidifying metal in either of the above-noted stirring methods.

For purposes of illustration, the present invention will be described in accordance with the following example.

EXAMPLE I

A 10 lb. supply of molten copper Alloy 510 (Cu—4.7% Sn—0.04% P) was poured into a 3 turn AC induction coil and suspended therein. The induction coil was made from $\frac{3}{8}$" diameter drawn copper tubing. The coil height was 2" and the diameter was $4\frac{1}{2}$". The power input to the induction coil to effect vibration of the molten copper was 26 volts, 1345 amps at a frequency of 2600 cps. The molten metal was cooled so as to effect a cooling rate of 4° C. per minute. Complete solidification of the copper alloy was allowed to occur. The slug was then expelled from the induction coil, reheated to 1063° C. and quenched. Sections of the cast copper alloy were then prepared for microscopic examination.

Figure 2:
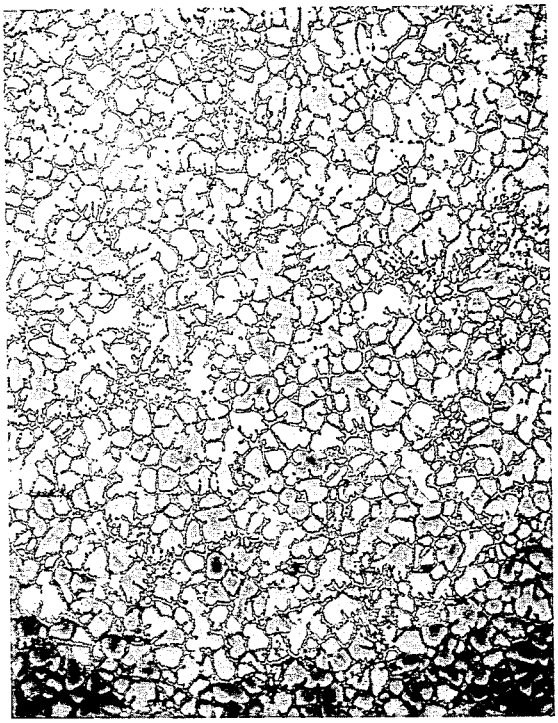
FIG. 2 is a micrograph of the structure of copper Alloy 510 which was prepared from a thixotropic slurry prepared in accordance with the present invention.

FIG. 1 is a micrograph of a sample of copper Alloy 510 which was cast by the conventional chill cast method. As can be seen from FIG. 1, the structure developed in copper Alloy 510 castings, when not cast from thixotropic slurries, shows a typical columnar dendritic structure. If one were to compare the microstructure of copper Alloy 905 when cast from a thixotropic slurry prepared from the conventional mechanical stirring method disclosed in previously cited U.S. Pat. No. 3,948,650. The microstructure would be found to be free from the typical dendritic network structure and the solid would appear as a degenerate dendritic structure comprising solid spheroids. FIG. 2 is a micrograph of copper Alloy 510 prepared in accordance with the present invention as outlined above. The microstructure of FIG. 2 is remarkably similar to that structure which is attained by processing the molten metal by conventional mechanical stirring techniques. The degree of dendritic sphericity achieved by employing the process of the present invention is similar to that which can be achieved by mechanical stirring. Thus, the process of the present invention allows for the production of semi-solid thixotropic slurries for use in known forming processes while over-coming the limited volume throughput and extreme wear and erosion which occurs when employing the conventional method disclosed in the aforenoted patents.

The process of the present invention employing electromagnetic stirring is superior to the known mechanical stirring method and offers an efficient and economical method for the production of thixotropic slurries with advantages neither envisioned nor contemplated by the aforenoted patents.

The above example is meant to be merely illustrative of the present invention. The present invention can be employed on any metal alloy system regardless of the chemical composition.

It is to be understood that the invention is not limited to the illustration described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for producing a thixotropic metal or alloy composition containing discrete degenerate dendritic primary solid particles homogeneously suspended in a secondary phase having a lower melting point than said primary solid particles which comprises the steps of:

(1) heating a metal or alloy to produce at least a partially liquid mixture comprising between 20 and 80% volume fraction primary solid particles;

(2) supplying a current in the range of 500 to 10,000 amps to an AC induction coil at a frequency in the range of from 60 to 10,000 cps to form an induced electromagnetic force field of sufficient intensity to vigorously agitate said partially liquid mixture;

(3) placing said partially liquid mixture within said induced electromagnetic force field;

(4) holding said partially liquid mixture within said induced electromagnetic force field for sufficient duration to vigorously agitate said partially liquid mixture so as to convert said primay solid particles to discrete degenerate dendrites of substantially spheroidal configuration; and (5) simultaneously cooling said partially liquid mixture during said holding step at a cooling rate determined so as to counteract the heating effect of the induced current of said electromagnetic force field and maintain said volume fraction of primary solid particles.

2. A process according to claim 1 wherein said metal is heated above its liquidus temperature and thereafter cooled to produce said at least partially liquid mixture.

3. A process according to claim 1 wherein said metal is heated to a temperature below its liquidus to produce said at least partially liquid mixture.

4. A process according to claim 1 wherein said step of holding said partially liquid mixture within said induced electromagnetic force field is carried out by utilizing a second distinct induced electromagnetic force field.

5. A process according to claim 4 wherein said second electromagnetic induced field is of sufficient force to prevent flow of said at least partially liquid mixture from within said first electromagnetic induced field.

6. A process according to claim 4 wherein said second electromagnetic induced field is of sufficient force to provide continuous flow of said at least partially liquid mixture from within said first electromagnetic induced field at a rate sufficient to produce said discrete degenerate dendritic primary solid particles.

* * * * *

UNITED STATES PATENT AND TRADEMARK OFFICE

CERTIFICATE OF CORRECTION

PATENT NO. : 4,229,210

DATED : October 21, 1980

INVENTOR(S) : Joseph Winter, Derek E. Tyler & Michael J. Pryor

It is certified that error appears in the above—identified patent and that said Letters Patent is hereby corrected as shown below:

In Column 7, line 6, the word "illustration" should read ---illustrations---.

In Column 8, line 2, the word "primay" should read ---primary---.

Signed and Sealed this

*Twenty-first* Day of *September 1982*

[SEAL]

*Attest:*

GERALD J. MOSSINGHOFF

*Attesting Officer*

*Commissioner of Patents and Trademarks*